US012788151B2

(12) United States Patent
Lee et al.

(10) Patent No.: US 12,788,151 B2
(45) Date of Patent: Nov. 10, 2026

(54) CHAIR

(71) Applicant: SIDIZ INC., Pyeongtaek-si (KR)

(72) Inventors: Young Tak Lee, Seoul (KR); Dae Ho Yoon, Seoul (KR); Sang Jae Lee, Seongnam-si (KR)

(73) Assignee: SIDIZ INC., Pyeongtaek-si (KR)

( * ) Notice: Subject to any disclaimer, the term of this patent is extended or adjusted under 35 U.S.C. 154(b) by 141 days.

(21) Appl. No.: 18/847,583

(22) PCT Filed: Mar. 17, 2022

(86) PCT No.: PCT/KR2022/003711
§ 371 (c)(1),
(2) Date: Sep. 16, 2024

(87) PCT Pub. No.: WO2023/176995
PCT Pub. Date: Sep. 21, 2023

(65) Prior Publication Data

US 2025/0221538 A1 Jul. 10, 2025

(51) Int. Cl.
*A47C 7/44* (2006.01)
*A47C 7/00* (2006.01)
*A47C 7/46* (2006.01)

(52) U.S. Cl.
CPC ..... *A47C 7/44* (2013.01); *A47C 7/462* (2013.01); *A47C 7/004* (2013.01); *A47C 7/006* (2013.01)

(58) Field of Classification Search
CPC ..... A47C 7/44; A47C 7/462
See application file for complete search history.

(56) References Cited

U.S. PATENT DOCUMENTS

2011/0193387 A1 8/2011 Kim
2012/0025574 A1 2/2012 Wilkinson et al.

FOREIGN PATENT DOCUMENTS

CN 111955983 A * 11/2020 ..... A47C 7/462
JP 2007-152145 A 6/2007
(Continued)

OTHER PUBLICATIONS

Russian Office Action for related RU Application No. 2024125957 mailed Apr. 14, 2025 from Russian Federal Service for Intellectual Property.
(Continued)

*Primary Examiner* — Anthony D Barfield
(74) *Attorney, Agent, or Firm* — Paratus Law Group, PLLC

(57) ABSTRACT

Disclosed herein is a chair capable of enhancing seating comfort by bending a backrest frame when adjusting a forward/backward angle of a backrest to prevent separation of a lumbar from a waist of a user so that the entire backrest supports a load of the user and by distributing the user's load applied to the backrest. The chair includes a backrest frame configured to support a backrest, a seatback post coupled to a bottom of the backrest frame by means of a hinge and configured to be rotatable forwards and backwards about the bottom, a seatback slider coupled to the seatback post above the hinge so as to be slidable up and down, and seatback connector configured to interconnect the backrest frame and the seatback slider, wherein the seatback connector moves the backrest frame in a direction in which a load of a user is applied.

14 Claims, 14 Drawing Sheets

(56) References Cited

FOREIGN PATENT DOCUMENTS

| | | | | |
|---|---|---|---|---|
| JP | 2009-165659 | A | 7/2009 | |
| KR | 20-0336009 | Y1 | 12/2003 | |
| KR | 10-0903215 | B1 | 6/2009 | |
| KR | 10-1603998 | B1 | 3/2016 | |
| KR | 10-1980343 | B1 | 8/2019 | |
| KR | 10-2071448 | B1 | 1/2020 | |
| KR | 10-2022-0057134 | A | 5/2022 | |
| RU | 2518280 | C2 | 6/2014 | |
| WO | WO-2021214208 | A1 * | 10/2021 | ..... A47C 7/462 |

OTHER PUBLICATIONS

International Search Report for PCT/KR2022/003711 mailed Dec. 6, 2022 from Korean Intellectual Property Office.
Japanese Office Action for related JP Application No. 2024-554724 mailed Jul. 8, 2025 from Japan Patent Office.

* cited by examiner

CHAIR

CROSS-REFERENCE TO PRIOR APPLICATION

This Application is a National Stage Patent Application of PCT International Application No. PCT/KR2022/003711 (filed on Mar. 17, 2022), which is hereby incorporated by reference in its entirety.

BACKGROUND

The present disclosure relates to a chair, and more particularly, to a chair whose backrest is reclined.

In general, a chair whose backrest is reclined may be tilted (the forward/backward angle of the backrest may be adjusted) by a user sitting on the chair and then leaning his/her back against the backrest.

Korean Patent No. 10-1980343 (issued on Aug. 28, 2019) (hereinafter, referred to as "prior art") discloses "CHAIR WITH IMPROVED LUMBAR SUPPORT", which is a chair whose backrest is reclined.

The chair in the prior art includes a backseat frame that supports a backrest and a lumbar formed in the backseat frame to support the waist of a user.

In the prior art, the backrest is reclined as it is without the change in shape when the user leans his/her back against the backrest for tilting. Hence, when the user sits on the chair and performs the tilting, even if the user leans with his/her waist attached to the lumbar, his/her legs and hips remain at the same angle and only his/her back moves.

In this case, since the user's waist is separated from the lumbar, a gap may be formed therebetween. For this reason, the lumbar does not support the user's waist and only a part of the user's back touches the backrest, which may cause pressure to be applied only to the part where the back touches.

SUMMARY

An object of the present disclosure is to provide a chair capable of enhancing seating comfort by bending a backrest frame when adjusting a forward/backward angle of a backrest to prevent separation of a lumbar from a waist of a user so that the entire backrest supports a load of the user and by distributing the user's load applied to the backrest.

Another object of the present disclosure is to provide a chair in which a lumbar is able to push a user's lumbar region by allowing a lumbar cover to exert a force downwards when a backrest is reclined.

A further object of the present disclosure is to provide a chair that is capable of organically moving a seatback and a user's body without separation therebetween by moving a backrest when the user moves his/her body from side to side.

The present disclosure is not limited to the above-mentioned objects, and other objects of the present disclosure can be clearly understood by those skilled in the art to which the present disclosure pertains from the following description.

In accordance with an aspect of the present disclosure, there is provided a chair that includes a backrest frame, a seatback post, a seatback slider, and a seatback connector. The backrest frame supports a backrest. The seatback post is coupled to a bottom of the backrest frame by means of a hinge. The seatback post is rotatable forwards and backwards about the bottom. The seatback slider is coupled to the seatback post above the hinge so as to be slidable up and down. The seatback connector interconnects the backrest frame and the seatback slider. The seatback connector moves the backrest frame in a direction in which a load of a user is applied.

The seatback connector may be made of a soft material that is deformable by the user's load.

The seatback slider may have a connector insertion part protruding from its front surface. The connector insertion part may have an insertion space with an open front. The seatback connector may include a connector ring, a rear connector, and a front connector. The connector ring may have a through-hole formed to penetrate forwards and backwards for insertion of a front end of the connector insertion part. The rear connector may have a rear end inserted into the insertion space. The rear connector may have a front end protruding forwards of the connector insertion part for placement within the through-hole. The front connector may be coupled to a front end of the connector ring. The front connector may be fastened to the front end of the rear connector. The front connector may be fastened to the backrest frame.

The front connector may have an insertion groove formed on surface for insertion of the front end of the rear its rear connector.

The seatback slider may have a first fastening hole formed through the center of the insertion space. The front connector may have a second fastening hole formed at the center thereof to penetrate forwards and backwards. The rear connector may have a third fastening hole formed at the center thereof to penetrate forwards and backwards. The third fastening hole may have a larger diameter at its rear end than at its front end. The chair according to the present disclosure may further include a female fastening member and a male fastening member. The female fastening member may have a first head and a female stem. The first head may come into contact with a rear surface of the seatback slider. The female stem may protrude from a front surface of the first head. The female stem may be inserted into the rear end of the third fastening hole through the first fastening hole. The male fastening member may have a second head and a male stem. The second head may come into contact with a front surface of the front connector. The male stem may protrude from a rear surface of the second head. The male stem may be fastened to the female stem via insertion into the third fastening hole through the second fastening hole.

The front connector may have a second head cover protruding from the center of the front surface thereof to surround the second head.

The rear connector may have a first flange formed on an outer peripheral surface of the front end thereof to protrude radially for insertion into the insertion groove. The connector ring may have a second flange formed on an outer peripheral surface of the front end thereof to protrude radially. The connector ring may have a third flange insertion groove formed on an inner peripheral surface of the front end thereof. The front connector may have a third flange formed on an outer peripheral surface of a rear end thereof to protrude radially. The third flange may be inserted into the third flange insertion groove.

The front connector may have a fourth fastening hole formed to penetrate forwards and backwards. A fastening member, which is fastened to the backrest frame, may pass through the fourth fastening hole. The rear connector may have a fastening groove formed on its front surface. An end of the fastening member may be inserted into the fastening groove.

The seatback post may have an insertion groove formed on a front surface of its top, the insertion groove having a longer vertical length than the seatback slider. The seatback slider may have a slide coupling protrusion part formed on its rear surface. Within the insertion groove of the seatback post, a slide coupling groove part may be formed into which the slide coupling protrusion part is inserted, the slide coupling groove part having a longer vertical length than the slide coupling protrusion part. The slide coupling protrusion part may have a slide protrusion formed on each of both left and right sides thereof, the slide protrusion being inserted into a slide groove formed on each of both left and right sides of the slide coupling groove part so as to be movable up and down.

The backrest frame may include a backrest plate, a lumbar, and a lumbar cover. The seatback connector may be coupled to the backrest plate. The lumbar may be placed on a front surface of a bottom of the backrest plate. The lumbar may support a waist of the user. The lumbar cover may be coupled to a rear surface of the bottom of the backrest plate. The lumbar cover may support a load on the user's waist applied to the lumbar. A hinge joint that is coupled by means of the hinge may protrude from a bottom of the lateral center of the lumbar cover.

The hinge joint may protrude downwards from the bottom of the backrest plate.

The hinge joint may be formed as an elastic body.

The backrest plate may be formed as an elastic body. The backrest plate may be formed with a plurality of slits, which penetrate forwards and backwards and elongate from side to side.

The backrest may further include a backrest cushion. The backrest cushion may be placed on a front surface of the backrest plate. The backrest cushion may have cushioning properties. The lumbar may be positioned between the backrest cushion and the backrest plate.

The backrest plate may have a plurality of rigid reinforcement ribs protruding from a front surface of its top above the lumbar When the user reclines the seatback post while leaning his/her back against the backrest, the seatback slider may slide down, and the backrest frame may bend while rotating about the hinge so that its upper part moves backwards and its lower part moves forwards.

It is to be understood that both the foregoing general description and the following detailed description of the present disclosure are exemplary and explanatory and are intended to provide further explanation of the disclosure as claimed.

A chair according to the present disclosure has an effect of enhancing seating comfort since it does not apply local pressure by filling an empty space between a backrest and a waist as a waist support part moves forwards when the chair is tilted (the forward and backward angle of the backrest is adjusted), and by making the entire body of the user touch the backrest to distribute the load applied thereto.

In addition, in the chair according to the present disclosure, since a seatback connector moves a backrest frame in a direction in which the user's load is applied when the chair is tilted, both left and right sides of the backrest can always be attached to the user's back, and since the user's body moves together with the backrest during work or when the user moves his/her body on the chair, the seating comfort can be enhanced.

In addition, the chair according to the present disclosure has an effect of allowing a lumbar to push a user's lumbar region since a lumbar cover exerts force downwards by the bending angle of the backrest plate when the chair is tilted.

Furthermore, the chair according to the present disclosure has the effect of preventing clothes from rolling up due to friction with the backrest because the backrest naturally moves down and moves together with the user's back when the chair is tilted.

The present disclosure is not limited to the above effects, and other effects of the present disclosure can be clearly understood by those skilled in the art from description of the appended claims.

LIST OF REFERENCE NUMERALS

Figure 1:
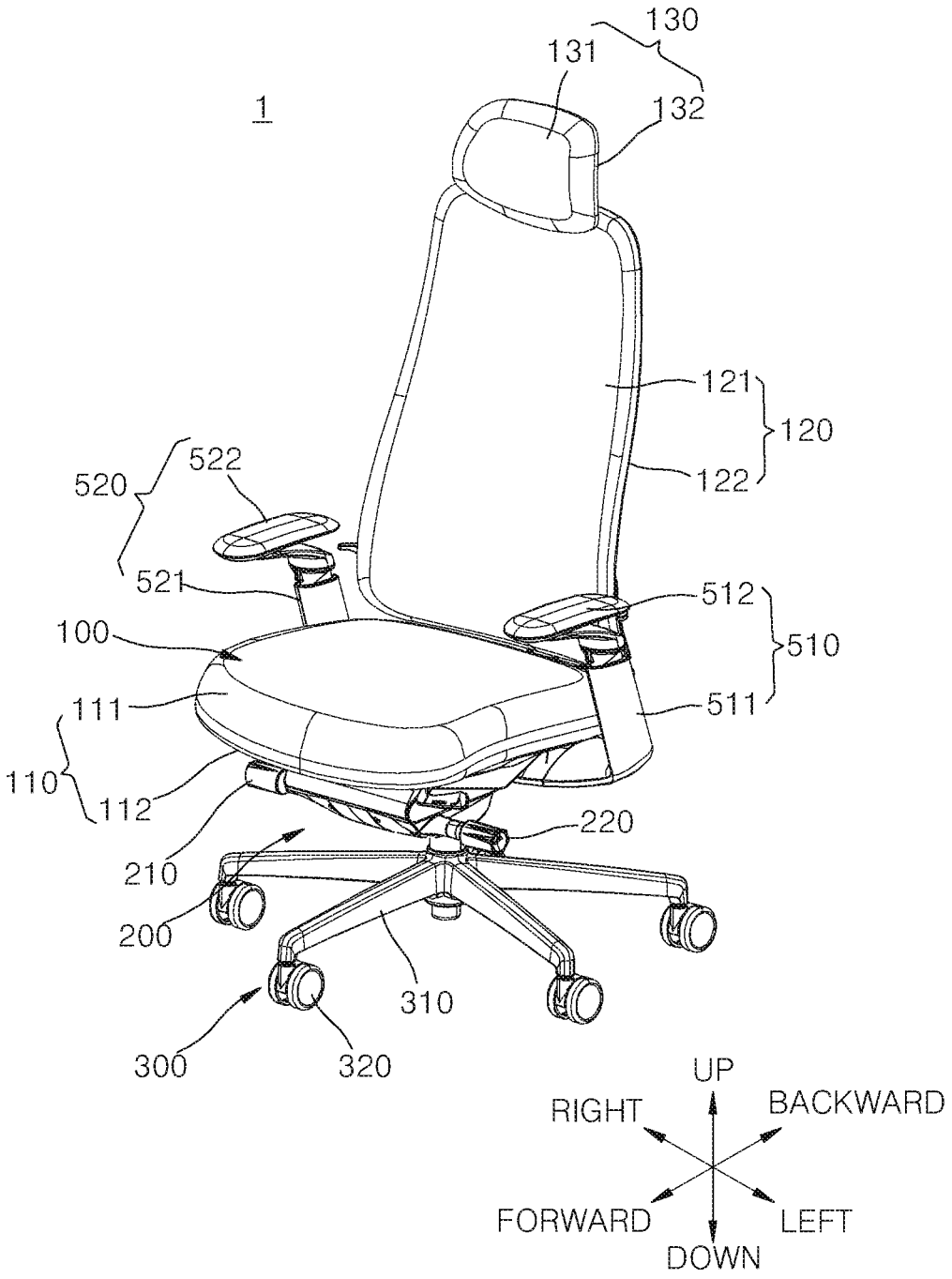
FIG. 1 is a front perspective view illustrating a chair according to an embodiment of the present disclosure.

120: backrest
121: backrest cushion
122: backrest frame
123: backrest plate
123A: rigid reinforcement rib
124: lumbar cover
125: lumbar
126: slit
127: hinge joint
400: seatback post
410: insertion groove
415: slide coupling groove part
600: seatback slider
615: slide coupling protrusion part
616: slide protrusion
620: connector insertion part
621: insertion space
622: first fastening hole
700: seatback connector
710: connector ring

711: through-hole
715: second flange
716: third flange insertion groove
720: rear connector
722: third fastening hole
725: first flange
727: fastening groove
730: front connector
731: insertion groove
732: second fastening hole
733: second head cover
735: third flange
737: fourth fastening hole
740: female fastening member
741: first head
742: female stem
750: male fastening member
751: second head
752: male stem H: hinge

DETAILED DESCRIPTION

Hereinafter, a chair according to exemplary embodiments of the present disclosure will be described with reference to the drawings.

Figure 2:
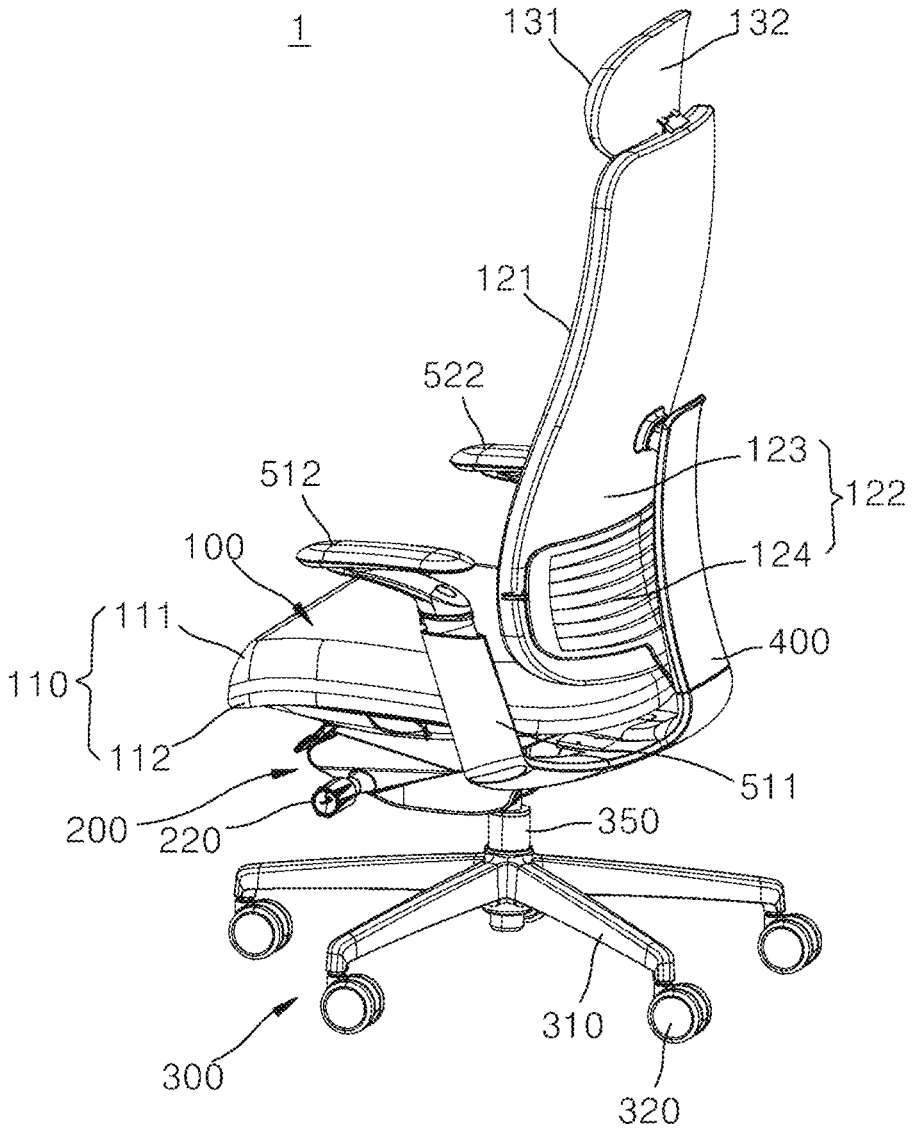
FIG. 2 is a rear perspective view illustrating the chair according to the embodiment of the present disclosure.

FIG. 1 is a front perspective view illustrating a chair according to an embodiment of the present disclosure. FIG. 2 is a rear perspective view illustrating the chair according to the embodiment of the present disclosure.

Referring to FIGS. 1 and 2, the chair, which is designated by reference numeral 1, according to the embodiment of the present disclosure may include a chair body 100, an adjustment device 200, a leg section 300, a seatback post 400, and an armrest section 510/520.

The chair body 100 may include a seat 110, a backrest 120, and a headrest 130. The seat 110, the backrest 120, and the headrest 130 may each have an approximately rectangular shape.

The seat 110 may extend forwards and backwards. The seat 110 may be a part for a user to sit on. The seat 110 may support the hips of the user and the thighs of both legs of the user.

The upper surface of the seat 110 may consist of a rear portion recessed slightly downwards to support the user's hips and a front portion inclined downwards toward its front to support both thighs of the user.

The backrest 120 may extend up and down such that its bottom is positioned in front of its top. The bottom of the backrest 120 may be coupled to the seatback post 400 by means of a hinge H (see FIG. 13). The hinge H may include a horizontal axis (not shown) elongated from side to side. The backrest 120 may be formed as a separate structure from the seat 110.

The headrest 130 may extend up and down. The headrest 130 may be coupled to the front surface of the top of the backrest 120. The headrest 130 may be formed integrally with the backrest 120, or may be coupled at the bottom thereof to the front surface of the top of the backrest 120 so as to be rotatable about a horizontal axis (not shown) elongated from side to side.

The seat 110 may include a seat cushion 111 and a seat plate 112. The seat cushion 111 may be placed on the upper side of the seat plate 112. The seat cushion 111 may be made of a material with cushioning properties to give the user a feeling of cushioning, and the seat plate 112 may be made of a harder material than the seat cushion 111 to support the seat cushion 111.

The backrest 120 may be a part for supporting the back of the user. The backrest 120 may include a backrest cushion 121 and a backrest frame 122. The backrest cushion 121 may be placed at the front of the backrest frame 122. The backrest cushion 121 may be made of a material with cushioning properties to give the user a feeling of cushioning, and the backrest frame 122 may be made of a harder material than the backrest cushion 121 to support the backrest cushion 121.

The backrest frame 122 may include a backrest plate 123, a lumbar 125 (see FIGS. 4 and 5), and a lumbar cover 124.

The backrest plate 123 may support the back and waist loads of the user. A seatback connector 700 (see FIG. 3) to be described later may be coupled to the rear surface of the backrest plate 123.

When the user sits on the chair 1, the bottom of the backrest plate 123 may be placed to face the user's waist. The lumbar 125 may be placed on the front surface of the bottom of the backrest plate 123 to support the user's waist. The lumbar 125 may be in the form of a plate with a concave front and a convex back so as to wrap around the user's waist. The lumbar cover 124 may be coupled to the rear surface of the bottom of the backrest plate 123 to support the user's waist load applied to the lumbar 125.

The headrest 130 may be a part for supporting the head of the user. The headrest 130 may include a headrest cushion 131 and a headrest plate 132. The headrest cushion 131 may be placed at the front of the headrest plate 132. The headrest cushion 131 may be made of a material with cushioning properties to give the user a feeling of cushioning, and the headrest plate 132 may be made of a harder material than the headrest cushion 131 to support the headrest cushion 131.

The seat cushion 111, the backrest cushion 121, and the headrest cushion 131 may be made of the same material, and the seat plate 112, the backrest frame 122, and the headrest plate 132 may be made of the same material.

The seat plate 112 and the headrest plate 132 may be slightly flexible so as to be slightly deformed by the load of the user sitting on the chair 1.

In particular, the backrest plate 123 may be formed as an elastic body for flexible deformation by the user's load applied to the backrest 120, thereby enhancing the seating comfort of the user sitting on the chair 1.

The adjustment device 200 may be placed on the lower side of the seat 110. The adjustment device 200 may be coupled to the lower side of the seat plate 112 of the seat 110. The adjustment device 200 may adjust the height of the chair body 100, as well as the forward/backward angle of the seatback post 400.

The adjustment device 200 may include two levers 210 and 220 operated by the user. The two levers 210 and 220 may be a first lever 210 placed to protrude on the right side of the adjustment device 200 to adjust the height of the chair body 100 by operation of the user, and a second lever 220 placed to protrude on the left side of the adjustment device 200 to adjust the forward/backward angle of the seatback post 400 by operation of the user.

A cylinder device 350 may be installed at the center of the leg section 300 to adjust the height of the chair body 100. The cylinder device 350 may be placed vertically. The cylinder device 350 may include a cylinder and a piston rod. The cylinder may be coupled to the center of the leg section 300 via insertion into a hole formed to penetrate vertically in the center of the leg section 300, and the upper end of the piston rod may be coupled to the adjustment device 200. If the user pulls the first lever 210 upwards while sitting on the chair body 100, the piston rod may be moved upwards as it is pulled out of the cylinder through a hole formed at the top of the cylinder, thereby allowing the user to adjust the height of the chair body 100.

The leg section 300 may be placed on the lower side of the adjustment device 200. The leg section 300 may support the adjustment device 200. The leg section 300 may include a plurality of leg bodies 310 arranged radially. In this embodiment, the plurality of leg bodies 310 are formed as five, but three or more may also be used. A wheel 320 may be rotatably coupled to the end of each of the leg bodies 310.

The seatback post 400 may support the backrest 120. The upper part of the seatback post 400 may extend up and down, and the lower part of the seatback post 400 may extend forwards by bending forwards from the bottom of the upper part of the seatback post 400. The top of the seatback post 400 may be positioned beneath the top of the backrest 120. The top of the seatback post 400 may be positioned beneath the top of the backrest plate 123. The lateral width of the seatback post 400 may be smaller than the lateral width of the backrest 120. The lateral width of the seatback post 400 may be smaller than the lateral width of the backrest plate 123. The upper part of the seatback post 400 may be placed to face the lateral center of the backrest 120 on the rear surface thereof. The upper part of the seatback post 400 may be placed to face the lateral center of the backrest plate 123 on the rear side thereof.

The armrest section 510/520 may support both left and right arms of the user. The armrest section 510/520 may include a left armrest part 510 that supports the user's left arm and a right armrest part 520 that supports the user's right arm. The left armrest part 510 and the right armrest part 520 may have the same structure.

The left armrest part 510 may include a left armrest post 511 and a left armrest 512.

The upper part of the left armrest post 511 may extend vertically, and the lower part of the left armrest post 511 may extend to the right by bending to the right from the bottom of the upper part of the left armrest post 511. The lower end of the left armrest post 511 may be coupled to the left side of the lower end of the seatback post 400.

The left armrest 512 may be a part for substantially supporting the left arm of the user. The left armrest 512 may have a left pad, which is an uppermost component that comes into contact with the left arm of the user. The left armrest 512 may have a left load coupled to the lower side of the left pad. The left load may be inserted into the left armrest post 511 through a hole formed at the top thereof, and may be adjusted in height by being pulled out of or inserted into the left armrest post 511 by operation of the user. In addition, the left pad may be adjusted forwards and backwards in position relative to the left load.

The upper part of the right armrest post 521 may extend vertically, and the lower part of the right armrest post 521 may extend to the left by bending to the left from the bottom of the upper part of the right armrest post 521. The lower end of the right armrest post 521 may be coupled to the right side of the lower end of the seatback post 400.

The right t 522 may be a part for substantially supporting the right arm of the user. The right armrest 522 may have a right pad, which is an uppermost component that comes into contact with the right arm of the user. The right armrest 522 may have a right load coupled to the lower side of the right pad. The right load may be inserted into the right armrest post 521 through a hole formed at the top thereof, and may be adjusted in height by being pulled out of or inserted into the right armrest post 521 by operation of the user. In addition, the right pad may be adjusted forwards and backwards in position relative to the right load.

Figure 3:
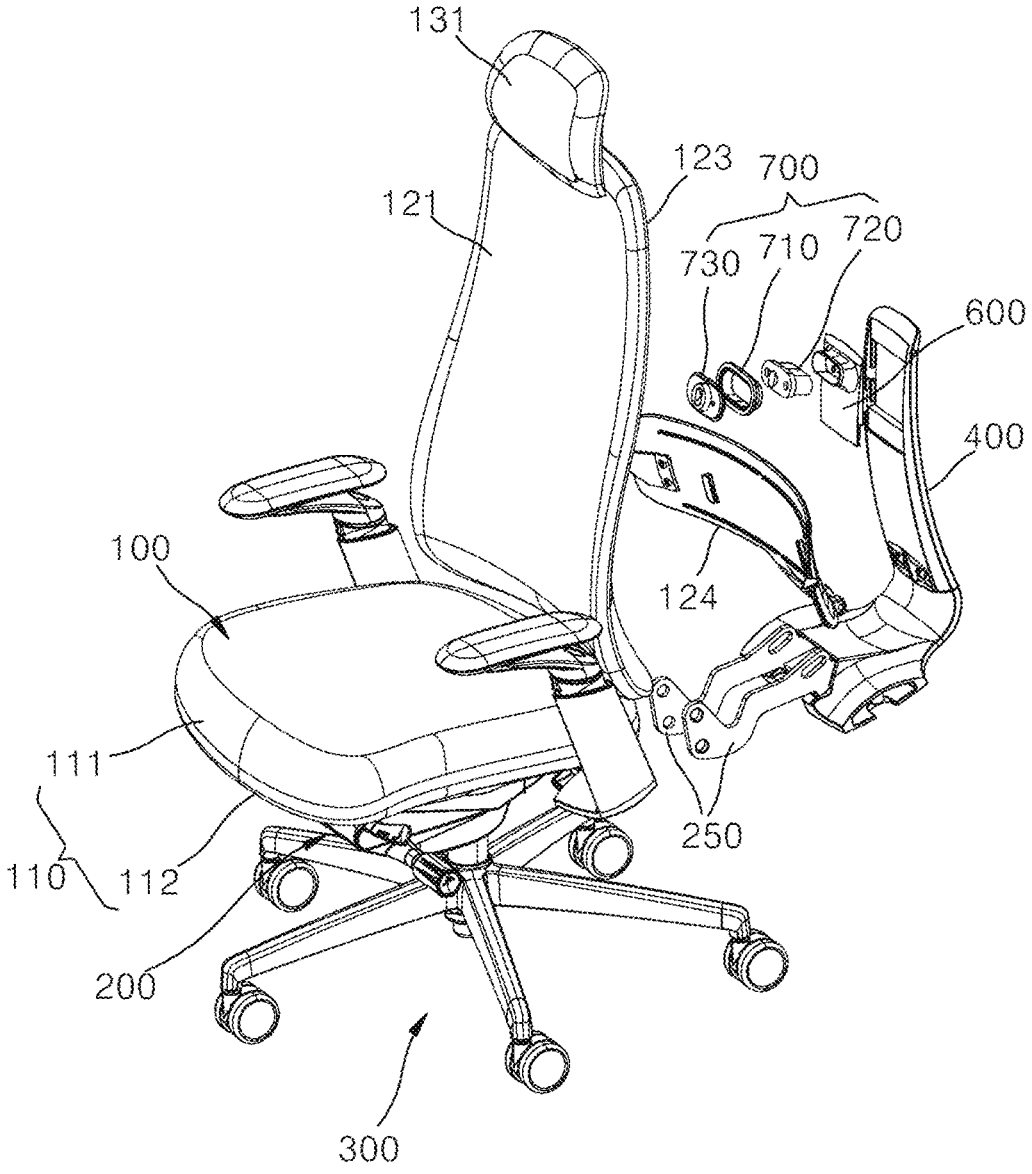
FIG. 3 is an exploded perspective view illustrating main components of the chair according to the embodiment of the present disclosure.

FIG. 3 is an exploded perspective view illustrating main components of the chair according to the embodiment of the present disclosure.

Referring to FIG. 3, the bottom of the seatback post 400 is placed to be rotatable about a horizontal axis (not shown) elongated from side to side, and the seatback post 400 may thus be tilted (adjusted forwards and backwards in angle) by rotation about the bottom thereof.

In other words, the adjustment device 200 may include a pair of tilting bridges 250 elongated forwards and backwards, the bottom of the seatback post 400 may be coupled to the rear ends of the tilting bridges 250 so as to be rotatable about the horizontal axis (not shown), and the front ends of the tilting bridges 250 may be coupled to the adjustment device 200.

Each of the tilting bridges 250 may have a hole formed at the rear end thereof, wherein the bottom of the seatback post 400 is coupled to the hole so as to be rotatable about the horizontal axis (not shown) elongated from side to side. Here, the hole may be elongated forwards and backwards.

Meanwhile, if the user reclines the seatback post 400 while sitting on the chair 1 and leaning his/her back against the backrest 120, the backrest frame 122 may be bent with the backrest 120 remaining in close contact with the back and waist of the user.

To this end, the bottom of the backrest frame 122 may be coupled to the seatback post 400 by means of the hinge H (see FIG. 13), and the top of the backrest frame 122 may be coupled to the top of the seatback post 400 through a seatback slider 600 and a seatback connector 700.

The seatback slider 600 may be coupled to the seatback post 400 above the hinge H so as to be slidable up and down, and the seatback connector 700 may connect the seatback slider 600 to the backrest frame 122.

If the user reclines the seatback post 400 while leaning his/her back against the backrest 120, the seatback slider 600 may slide downwards, so that the backrest frame 122 may bend while rotating about the hinge H, thereby allowing the upper and lower parts of the backrest 120 to be kept in close contact with the back and waist of the user. In this case, the seatback connector 700 may move the backrest frame 122 in a direction in which the user's load is applied, thereby allowing both left and right sides of the backrest 120 to be kept in close contact with the back and waist of the user.

As such, in order for the seatback connector 700 to move the backrest frame 122 in a direction in which the user's load is applied when the user tilts the backrest 120, it is preferable that the seatback connector 700 be made of a soft material that is deformable by the load of the user. In other words, when the user tilts the backrest 120, the seatback connector 700 is deformed by the load of the user, thereby moving the backrest frame 122 in a direction in which the user's load is applied.

The operation when the user tilts the backrest 120 will be described in detail later with reference to FIG. 14. First, the detailed structure of the backrest frame 122, the seatback slider 600, and the seatback connector 700 will be described below.

Figure 4:
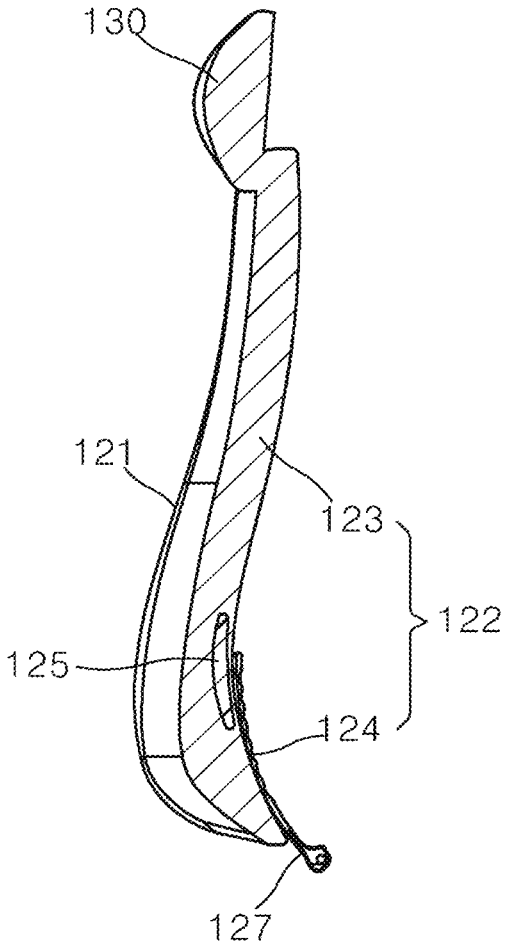
FIG. 4 is a side cross-sectional view schematically illustrating the backrest of FIGS. 1 to 3.
Figure 5:
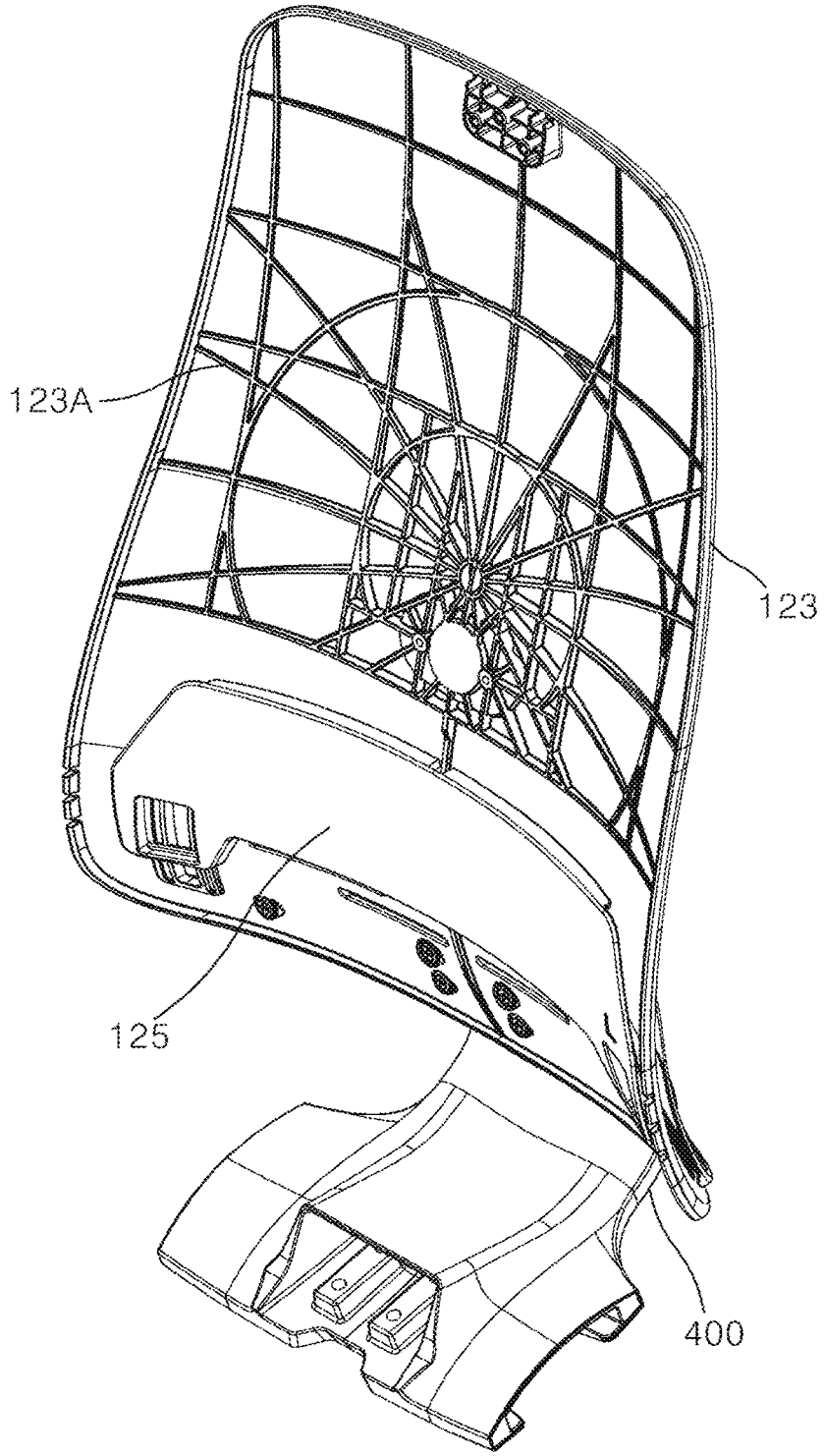
FIG. 5 is a front perspective view illustrating the backrest frame and seatback post of FIGS. 1 to 3.
Figure 6:
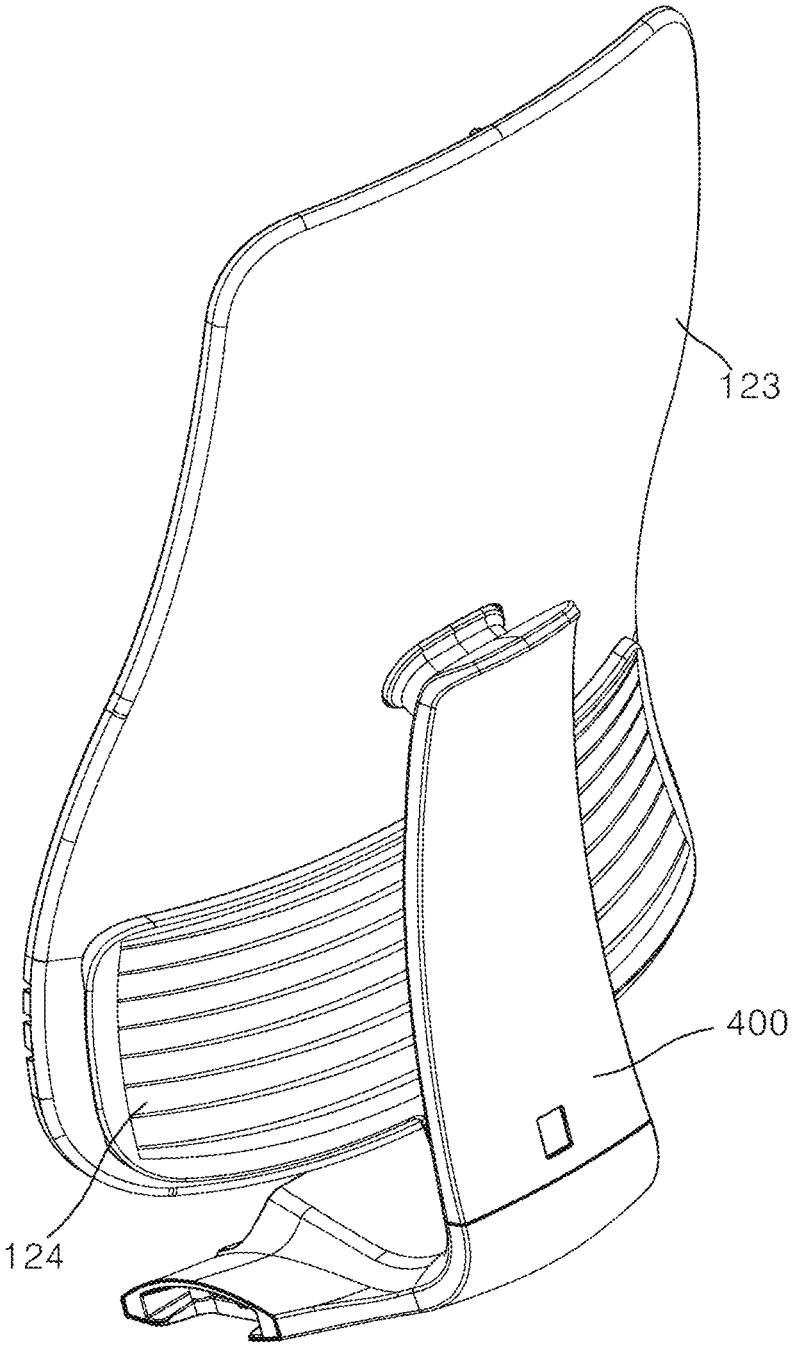
FIG. 6 is a rear perspective view illustrating the backrest frame and seatback post of FIGS. 1 to 3.
Figure 7:
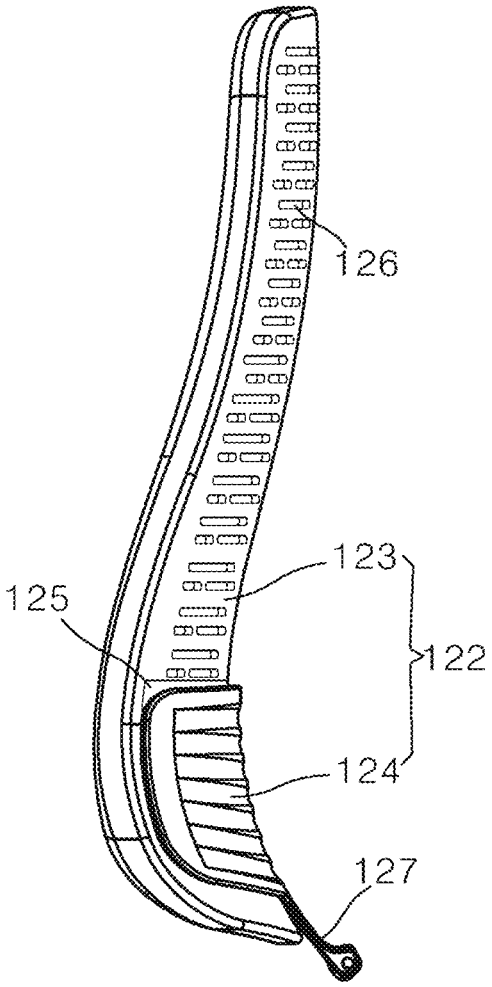
FIG. 7 is a side view specifically illustrating the backrest frame of FIG. 4.

FIG. 4 is a side cross-sectional view schematically illustrating the backrest of FIGS. 1 to 3. FIG. 5 is a front perspective view illustrating the backrest frame and seatback post of FIGS. 1 to 3. FIG. 6 is a rear perspective view illustrating the backrest frame and seatback post of FIGS. 1 to 3. FIG. 7 is a side view specifically illustrating the backrest frame of FIG. 4.

Referring to FIGS. 4 to 7, the backrest frame 122 may include the backrest plate 123, the lumbar 125, and the lumbar cover 124, as described above.

The backrest cushion 121 with cushioning properties may be coupled to the front surface of the backrest plate 123. The seatback connector 700 as described above may be coupled to the rear surface of the backrest plate 123. The backrest plate 123 may be covered at the outside thereof with a fiber cover for placement within the fiber cover.

The lumbar cover 124 may be coupled to the rear surface of the bottom of the backrest plate 123. The lumbar 125 for supporting the waist of the user may be coupled to the front surface of the lumbar cover 124 and may be placed on the front surface of the bottom of the backrest plate 123. The lumbar 125 may be positioned between the backrest cushion 121 and the backrest plate 123 to support the user's waist leaning against the backrest cushion 121. The lumbar 125 may be coupled to the lumbar cover 124 through a hole formed at the bottom of the backrest plate 123. The lumbar cover 124 may be coupled to the rear surface of the bottom of the backrest plate 123 to support the user's waist load applied to the lumbar 125.

A hinge joint 127, which is coupled by means of the hinge H (see FIG. 13), may protrude downwards from the bottom of the lateral center of the lumbar cover 124. The hinge joint 127 may protrude downwards from the bottom of the backrest plate 123. The hinge joint 127 may be formed as an elastic body for flexible deformation when the user tilts the backrest 120.

The backrest plate 123 may have a plurality of rigid reinforcement ribs 123A protruding from the front surface of the top thereof. The plurality of rigid reinforcement ribs 123A may be formed on the front surface of the top of the backrest plate 123 above the lumbar 125. The lumbar 125 may be placed on the front surface of the bottom of the backrest plate 123, which is a portion where the plurality of rigid reinforcement ribs 123A are not formed on the front surface of the backrest plate 123.

The plurality of rigid reinforcement ribs 123A allow the backrest plate 123 to have a strength capable of supporting the back load of the user as well as to have a strength capable of providing flexible bending by the back load of the use.

The plurality of rigid reinforcement ribs 123A may include a circular rib formed at the center of the front surface of the backrest plate 123, a first arced rib surrounding the circular rib, a second arced rib surrounding the first arced rib, a plurality of lattice ribs formed all over the front surface of the top of the backrest plate 123, and a plurality of straight ribs arranged radially to interconnect the circular rib, the first arced rib, the second arced rib, and the plurality of lattice ribs.

The backrest plate 123 may be formed as an elastic body for flexible deformation when the user tilts the backrest 120. The backrest plate 123 may be formed with a plurality of slits 126, which penetrate forwards and backwards and elongate from side to side, thereby allowing the backrest plate 123 to be easily deformed by the back and waist loads of the user.

Figure 8:
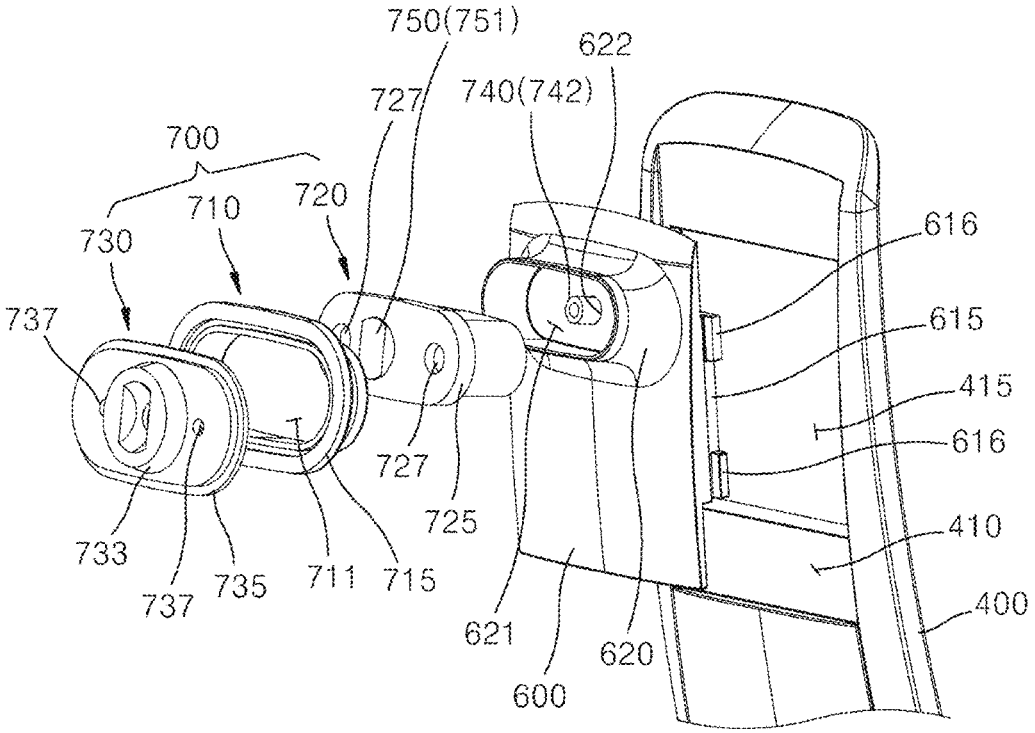
FIG. 8 is an exploded perspective view illustrating a top of the seatback post, a seatback slider, and a seatback connector.
Figure 9:
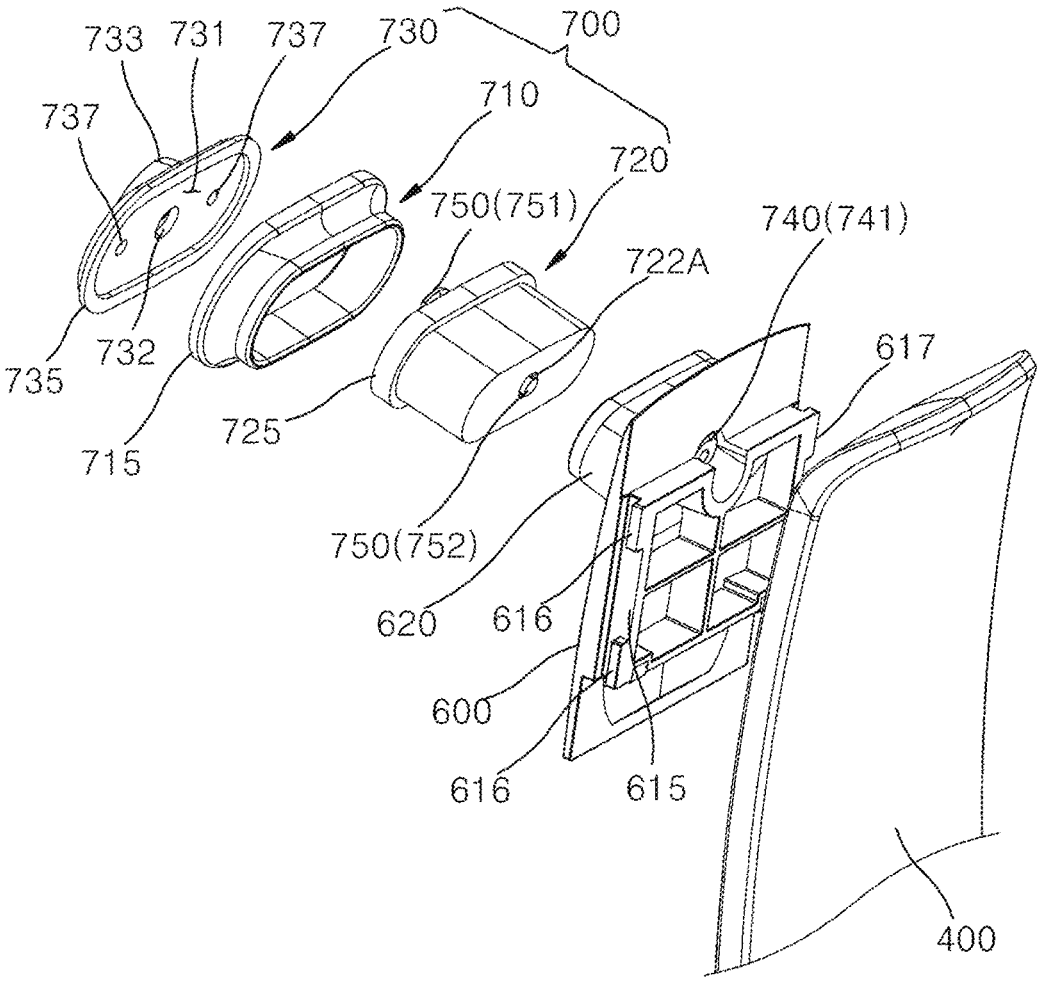
FIG. 9 is a rear perspective view of FIG. 8.
Figure 10:
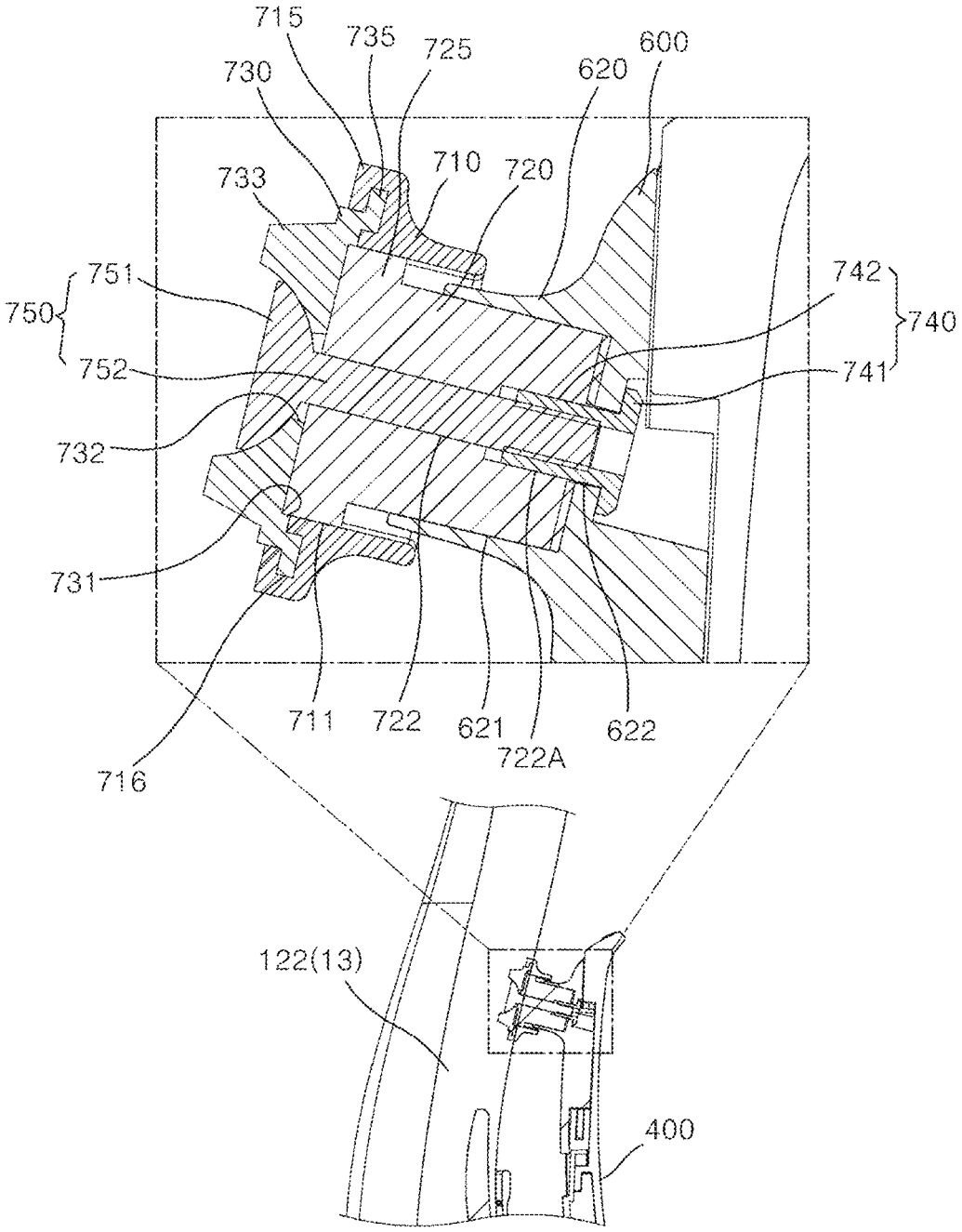
FIG. 10 is a side cross-sectional view illustrating a state in which the backrest frame is coupled to the top of the seatback post by the seatback slider and the seatback connector.

FIG. 8 is an exploded perspective view illustrating the top of the seatback post, the seatback slider, and the seatback connector. FIG. 9 is a rear perspective view of FIG. 8. FIG. 10 is a side cross-sectional view illustrating a state in which the backrest frame is coupled to the top of the seatback post by the seatback slider and the seatback connector.

Referring to FIGS. 8 to 10, the seatback slider 600 may be coupled to the front surface of the top of the seatback post 400 so as to be slidable forwards and backwards. The seatback post 400 may have an insertion groove 410 formed on the front surface of the top thereof for insertion of the seatback slider 600. The vertical length of the insertion groove 410 may be longer than the vertical length of the seatback slider 600. The seatback slider 600 may slide up and down within a range until the top of the seatback slider 600 comes into contact with the upper side within the insertion groove 410 and the bottom of the seatback slider 600 comes into contact with the lower side within the insertion groove 410.

The seatback slider 600 may have a vertically elongated rectangular shape. The seatback slider 600 may have a slide coupling protrusion part 615 formed to protrude from the rear surface thereof. The slide coupling protrusion part 615 may have an edge in the form of a rectangle elongated from side to side, and may have a plurality of spaces defined therein.

Within the insertion groove 410 of the seatback post 400, a slide coupling groove part 415 may be formed into which the slide coupling protrusion part 615 is inserted. The vertical length of the slide coupling groove part 415 may be longer than the vertical length of the slide coupling protrusion part 615. The seatback slider 600 may slide up and down within a range until the top of the slide coupling protrusion part 615 comes into contact with the upper side within the slide coupling groove part 415 and the bottom of the slide coupling protrusion part 615 comes into contact with the lower side within the slide coupling groove part 415.

The slide coupling protrusion part 615 may have a slide protrusion 616/617 formed on both left and right sides thereof. The slide protrusion 616/617 may include a first slide protrusion 616 formed on the left side of the slide coupling protrusion part 615 and a second slide protrusion 617 formed on the right side of the slide coupling protrusion part 615. The first slide protrusion 616 may be formed as a pair on the left side of the slide coupling protrusion part 615. Additionally or alternatively, at least one first slide protrusion 616 may be formed on the left side of the slide coupling protrusion part 615. The second slide protrusion 617 may be formed as a pair on the right side of the slide coupling protrusion part 615. Additionally or alternatively, at least one second slide protrusion 617 may be formed on the right side of the slide coupling protrusion part 615.

Preferably, the slide coupling groove part 415 has a slide groove (not shown) formed on both left and right sides thereof, so that the slide protrusion 616/617 is inserted into the slide groove so as to be movable up and down.

The seatback slider 600 may have a connector insertion part 620 protruding from the front surface thereof. The connector insertion part 620 may have an insertion space 621 with an open front. The connector insertion part 620 may be in the form of a cylinder with an open front. The connector insertion part 620 may have an elliptical longitudinal section. Alternatively, the connector insertion part 620 may have a circular longitudinal section or a polygonal longitudinal section.

The seatback slider 600 may have a first fastening hole 622 formed through the center of the insertion space 621.

The seatback connector 700 may include a connector ring 710, a rear connector 720, and a front connector 730. The connector ring 710, the rear connector 720, and the front connector 730 may have a shape corresponding to the connector insertion part 620. In other words, the connector ring 710, the rear connector 720, and the front connector 730 may each have an elliptical longitudinal section.

The connector ring 710 may have a through-hole 711 formed to penetrate forwards and backwards for insertion of the front end of the connector insertion part 620.

The rear end of the rear connector 720 may be inserted into the insertion space 621 of the connector insertion part 620. The front end of the rear connector 720 may protrude forwards of the connector insertion part 620 for placement within the through-hole 711 of the connector ring 710.

The front connector 730 may be coupled to the front end of the connector ring 710. The front connector 730 may be fastened to the front end of the rear connector 720. The front connector 730 may have an insertion groove 731 formed on the rear surface thereof for insertion of the front end of the rear connector 720.

The front connector 730 may have a second fastening hole 732 formed at the center thereof to penetrate forwards and backwards. The rear connector 720 may have a third fastening hole 722 formed at the center thereof to penetrate forwards and backwards. The third fastening hole 722 may have a larger diameter at the rear end 722A thereof than at the front end thereof.

The connector ring 710, the rear connector 720, the front connector 730, and the seatback slider 600 may be fastened to one another through a female fastening member 740 and a male fastening member 750. In other words, the seatback connector 700 may be fastened to the seatback slider 600 through the female fastening member 740 and the male fastening member 750.

The female fastening member 740 may have a first head 741 and a female stem 742. The first head 741 may comes into contact with the rear surface of the seatback slider 600. The female stem 742 may protrude from the front surface of the first head 741. The female stem 742 may be inserted into the rear end 722A of the third fastening hole 722 through the first fastening hole 622.

The male fastening member 750 may have a second head 751 and a male stem 752. The second head 751 may comes into contact with the front surface of the front connector 730. The male stem 752 may protrude from the rear surface of the second head 751. The male stem 752 may be fastened to the female stem 742 via insertion into the third fastening hole 722 through the second fastening hole 732.

The female stem 742 may have a thread formed on the inner peripheral surface thereof, and the male stem 752 may have a thread formed on the outer peripheral surface thereof and screwed with the thread formed on the inner peripheral surface of the female stem 742.

The female stem 742 and the male stem 752 may be fastened to each other within the rear end 722A of the third fastening hole 722.

The front connector 730 may have a second head cover 733 protruding from the center of the front surface thereof to surround the second head 751. The second fastening hole 732 may be formed to penetrate forwards and backwards at the center of the internal space of the second head cover 733.

The second head cover 733 may have an inner peripheral surface formed as a first curved surface that is concave backwards, and the second head 751 may have a rear surface formed as a second curved surface that is convex backwards to match the first curved surface.

The rear connector 720 may have a first flange 725 formed on the outer peripheral surface of the front end thereof to protrude radially for insertion into the insertion groove 731 formed on the rear surface of the front connector 730.

The connector ring 710 may have a second flange 715 formed on the outer peripheral surface of the front end thereof to protrude radially. The connector ring 710 may have a third flange insertion groove 716 (see FIG. 10) formed on the inner peripheral surface of the front end thereof.

The front connector 730 may have a third flange 735 formed on the outer peripheral surface of the rear end thereof to protrude radially. The third flange 735 may be inserted into the third flange insertion groove 716.

The front connector 730 may have a fourth fastening hole 737 formed to penetrate forwards and backwards. A fastening member (e.g., bolt (not shown)), which is fastened to the backrest plate 123 of the backrest frame 122, may pass through the fourth fastening hole 737. The rear connector 720 may have a fastening groove 727 formed on the front surface thereof. The end of the fastening member that has passed through the fourth fastening hole 737 may be inserted into the fastening groove 727. In other words, the seatback connector 700 may be fastened to the backrest plate 123 of the backrest frame 122 through the fastening member.

The fourth fastening hole 737 may be positioned outside the second head cover 733. The fourth fastening hole 737 and the fastening groove 727 may be provided in multiples. In this embodiment, the fourth fastening hole 737 and the fastening groove 727 may each be provided as a pair.

Figure 11:
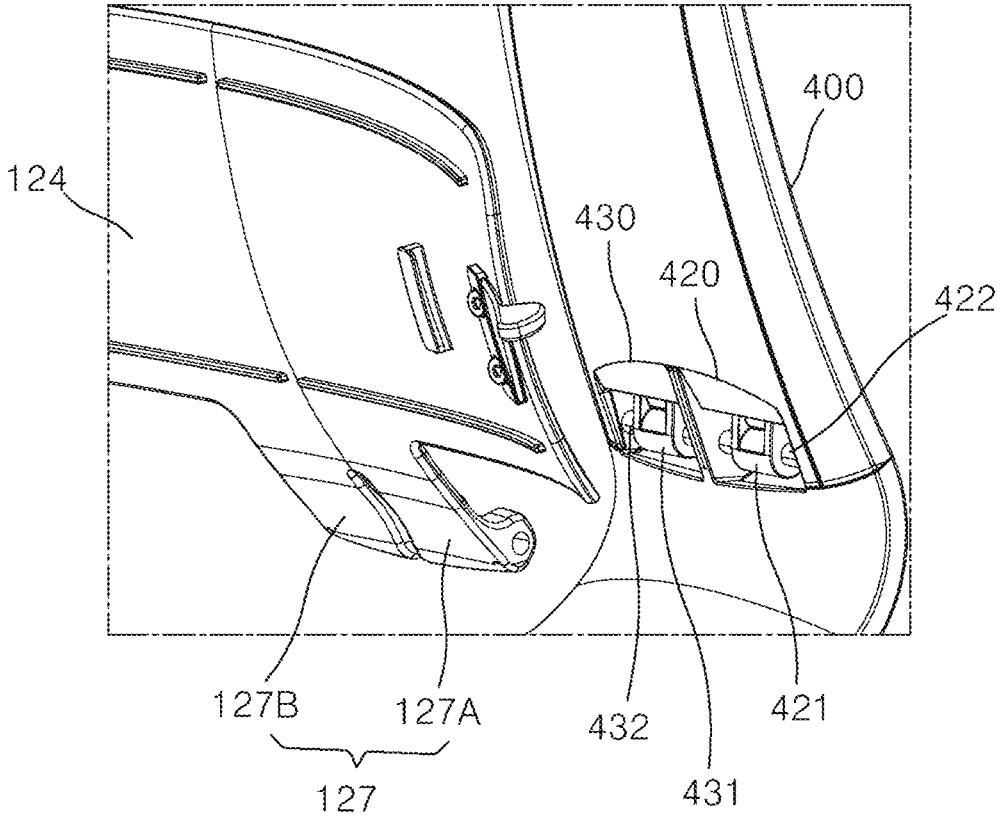
FIG. 11 is an exploded perspective view illustrating a bottom of the backrest frame and the seatback post.
Figure 12:
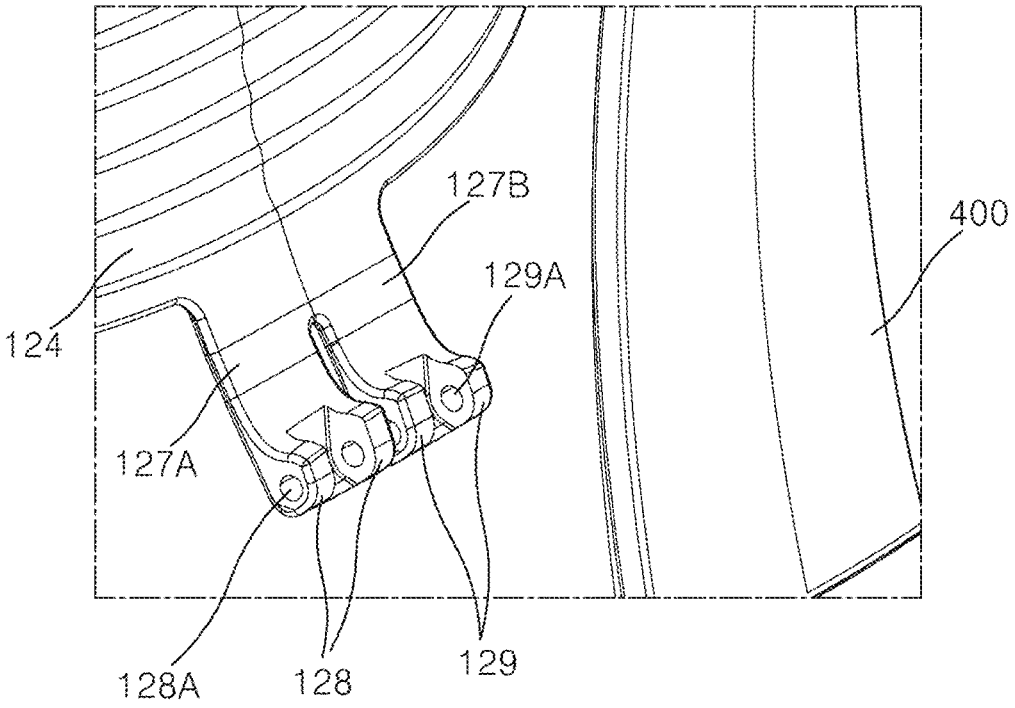
FIG. 12 is a rear perspective view of FIG. 11.
Figure 13:
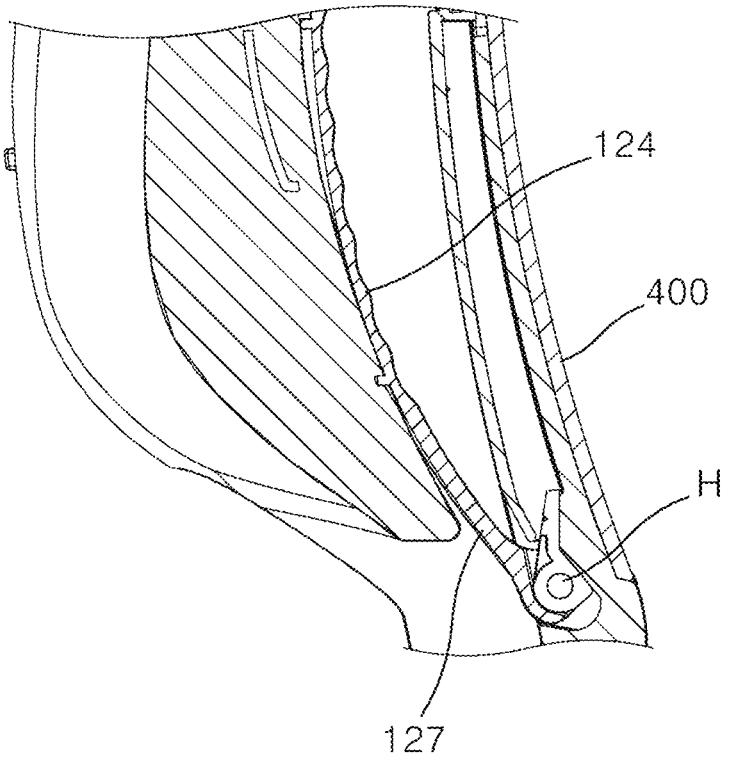
FIG. 13 is a side cross-sectional view illustrating a state in which the bottom of the backrest frame is coupled to the seatback post by means of a hinge.

FIG. 11 is an exploded perspective view illustrating the bottom of the backrest frame and the seatback post. FIG. 12 is a rear perspective view of FIG. 11. FIG. 13 is a side cross-sectional view illustrating a state in which the bottom of the backrest frame is coupled to the seatback post by means of the hinge.

Referring to FIGS. 11 to 13, the hinge joint 127, which is coupled to the seatback post 400 by means of the hinge H, may protrude from the bottom of the lumbar cover 124, as described above.

The hinge joint 127 may be divided into two parts: a left hinge joint 127A positioned on the left side thereof; and a right hinge joint 127B positioned on the right side thereof.

The left hinge joint 127A may have a pair of first hinge protrusions 128, which are formed on the rear surface of the bottom thereof and laterally spaced apart from each other. The pair of first hinge protrusions 128 may each have a first hinge hole 128A formed to penetrate from side to side.

The right hinge joint 127B may have a pair of second hinge protrusions 129, which are formed on the rear surface of the bottom thereof and laterally spaced apart from each other. The pair of second hinge protrusions 129 may each have a second hinge hole 129A formed to penetrate from side to side.

The seatback post 400 may have a first hinge groove 420 and a second hinge groove 430 formed on the front surface thereof, wherein the pair of first hinge protrusion 128 are inserted into the first hinge groove 420 and the pair of second hinge protrusions 129 are inserted into the second hinge groove 430. The first hinge groove 420 and the second hinge groove 430 may be arranged from side to side.

The first hinge groove 420 may have a first insertion protrusion 421 formed therein for insertion between the pair of first hinge protrusions 128. The first insertion protrusion 421 may have first coupling protrusions 422 formed on both left and right sides thereof, wherein the first coupling protrusions 422 are rotatably coupled to the pair of first hinge protrusions 128 via insertion into the first hinge holes 128A formed in the respective first hinge protrusions 128.

The second hinge groove 430 may have a second insertion protrusion 431 formed therein for insertion between the pair of second hinge protrusions 129. The second insertion protrusion 431 may have second coupling protrusions 432 formed on both left and right sides thereof, wherein the second coupling protrusions 432 are rotatably coupled to the pair of second hinge protrusions 129 via insertion into the second hinge holes 129A formed in the respective second hinge protrusions 129.

The pair of first hinge protrusions 128, the pair of second hinge protrusions 129, the first coupling protrusions 422 formed on both left and right sides of the first insertion protrusion 421, and the second coupling protrusions 432 formed on both left and right sides of the second insertion protrusion 431 may be substantially coupled to one another by means of the hinge H.

The operation of the chair according to the embodiment of the present disclosure configured as described above is as follows.

Figure 14:
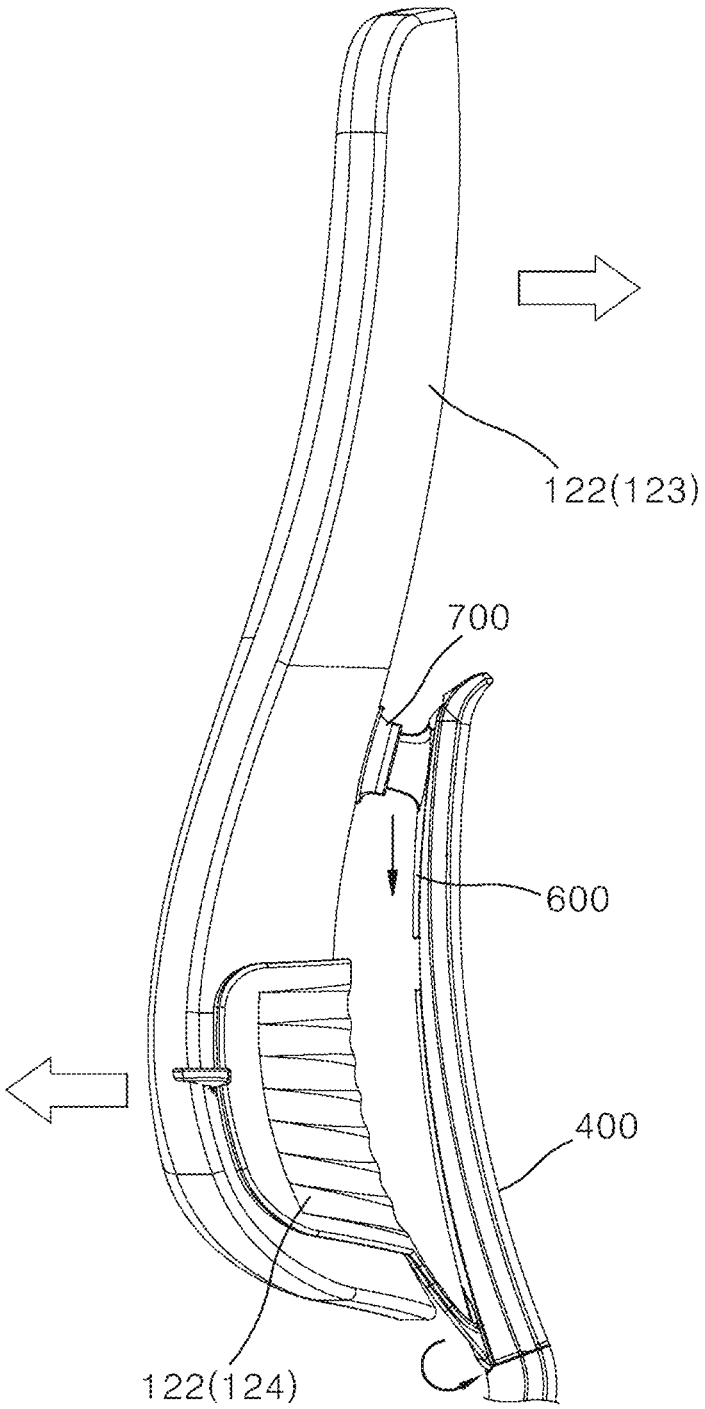
FIG. 14 is a view illustrating an operation when the user reclines the seatback post while leaning his/her back against the backrest.

FIG. 14 is a view illustrating an operation when the user reclines the seatback post while leaning his/her back against the backrest.

Referring to FIGS. 13 and 14, if the user reclines the seatback post 400 while leaning his/her back against the backrest 120, the seatback slider 600 slides down, and the backrest frame 122 bends while rotating about the hinge H so that the upper part thereof moves backwards and the lower part thereof moves forwards. Accordingly, the user may keep his/her back in close contact with the upper part of the backrest 120, and may also keep his/her waist in close contact with the lower part of the backrest 120.

In addition, if the user reclines the seatback post 400 while leaning his/her back against the backrest 120, the seatback connector 700 is deformed by the load applied thereto to move the backrest frame 122 in a direction in which the user's load is applied. Accordingly, both left and right sides of the backrest 120 may be kept in close contact with the back of the user.

As described above, the chair 1 according to the embodiment of the present disclosure can enhance seating comfort since it does not apply local pressure by filling an empty space between the backrest and the waist as the lower part of the backrest 120, which is a waist support part, moves forwards, when the chair is tilted (the forward and backward angle of the backrest is adjusted), and by making the entire body of the user touch the backrest 120 to distribute the load applied thereto.

In addition, in the chair 1 according to the embodiment of the present disclosure, since the seatback connector 700 moves the backrest frame 122 in a direction in which the user's load is applied when the chair is tilted, both left and right sides of the backrest 120 can always be attached to the user's back, and since the user's body moves together with the backrest 120 during work or when the user moves his/her body on the chair, the seating comfort can be enhanced.

In addition, the chair 1 according to the embodiment of the present disclosure can allow the lumbar 125 to push the user's lumbar region since the lumbar cover 124 exerts force downwards by the bending angle of the backrest plate 123 when the chair is tilted.

Furthermore, the chair 1 according to the embodiment of the present disclosure can prevent clothes from rolling up due to friction with the backrest 120 because the backrest 120 naturally moves down and moves together with the user's back when the chair is tilted.

It will be understood by those skilled in the art that various modifications may be made without departing from the spirit and scope or essential features of the disclosure. Therefore, it should be understood that the embodiments described above are for purposes of illustration only in all aspects and are not intended to limit the scope of the present disclosure. The scope of the present disclosure is defined by the appended claims, and it should be construed that all modifications or variations derived from the meaning, scope, and equivalent concept of the claims fall within the scope of the disclosure.

The present disclosure is directed to a chair capable of enhancing seating comfort by bending a backrest frame when adjusting a forward/backward angle of a backrest to prevent separation of a lumbar from a waist of a user so that the entire backrest supports a load of the user and by distributing the user's load applied to the backrest.

The invention claimed is:

1. A chair comprising:

a backrest frame configured to support a backrest;

a seatback post coupled to a bottom of the backrest frame by means of a hinge and configured to be rotatable forwards and backwards about the bottom;

a seatback slider coupled to the seatback post above the hinge so as to be slidable up and down; and a seatback connector configured to interconnect the backrest frame and the seatback slider, wherein the seatback connector moves the backrest frame in a direction in which a load of a user is applied, wherein the seatback slider has a connector insertion part protruding from its front surface, the connector insertion part having an insertion space with an open front, and wherein the seatback connector comprises:

a connector ring having a through-hole formed to penetrate forwards and backwards for insertion of a front end of the connector insertion part;

a rear connector having a rear end inserted into the insertion space and a front end protruding forwards of the connector insertion part for placement within the through-hole; and a front connector coupled to a front end of the connector ring, fastened to the front end of the rear connector, and fastened to the backrest frame.

2. Chair according to claim 1, wherein the seatback connector is made of a soft material that is deformable by the user's load.

3. The chair according to claim 1, wherein the front connector has an insertion groove formed on its rear surface for insertion of the front end of the rear connector.

4. The chair according to claim 3, wherein the seatback slider has a first fastening hole formed through the center of the insertion space, wherein the front connector has a second fastening hole formed at the center thereof to penetrate forwards and backwards, wherein the rear connector has a third fastening hole formed at the center thereof to penetrate forwards and backwards, wherein the third fastening hole has a larger diameter at its rear end than at its front end, and wherein the chair further comprises: a female fastening member having a first head coming into contact with a rear surface of the seatback slider, and a female stem protruding from a front surface of the first head and inserted into the rear end of the third fastening hole through the first fastening hole; and a male fastening member having a second head coming into contact with a front surface of the front connector, and a male stem protruding from a rear surface of the second head and fastened to the female stem via insertion into the third fastening hole through the second fastening hole.

5. The chair according to claim 4, wherein the front connector has a second head cover protruding from the center of the front surface thereof to surround the second head.

6. The chair according to claim 4, wherein:

the rear connector has a first flange formed on an outer peripheral surface of the front end thereof to protrude radially for insertion into the insertion groove;

the connector ring has a second flange formed on an outer peripheral surface of the front end thereof to protrude radially, and a third flange insertion groove formed on an inner peripheral surface of the front end thereof; and the front connector has a third flange formed on an outer peripheral surface of a rear end thereof to protrude radially, the third flange being inserted into the third flange insertion groove.

7. The chair according to claim 4, wherein:

the front connector has a fourth fastening hole formed to penetrate forwards and backwards, a fastening member, which is fastened to the backrest frame, passing through the fourth fastening hole; and the rear connector has a fastening groove formed on its front surface, an end of the fastening member being inserted into the fastening groove.

8. The chair according to claim 1, wherein when the user reclines the seatback post while leaning his/her back against the backrest, the seatback slider slides down, and the backrest frame bends while rotating about the hinge so that its upper part moves backwards and its lower part moves forwards.

9. A chair comprising:

a backrest frame configured to support a backrest;

a seatback post coupled to a bottom of the backrest frame by means of a hinge and configured to be rotatable forwards and backwards about the bottom;

a seatback slider coupled to the seatback post above the hinge so as to be slidable up and down; and a seatback connector configured to interconnect the backrest frame and the seatback slider, wherein the seatback connector moves the backrest frame in a direction in which a load of a user is applied, wherein:

the seatback post has an insertion groove formed on a front surface of its top, the insertion groove having a longer vertical length than the seatback slider;

the seatback slider has a slide coupling protrusion part formed on its rear surface;

within the insertion groove of the seatback post, a slide coupling groove part is formed into which the slide coupling protrusion part is inserted, the slide coupling groove part having a longer vertical length than the slide coupling protrusion part; and the slide coupling protrusion part has a slide protrusion formed on each of both left and right sides thereof, the slide protrusion being inserted into a slide groove formed on each of both left and right sides of the slide coupling groove part so as to be movable up and down.

10. A chair comprising:

a backrest frame configured to support a backrest;

a seatback post coupled to a bottom of the backrest frame by means of a hinge and configured to be rotatable forwards and backwards about the bottom;

a seatback slider coupled to the seatback post above the hinge so as to be slidable up and down; and a seatback connector configured to interconnect the backrest frame and the seatback slider, wherein the seatback connector moves the backrest frame in a direction in which a load of a user is applied, wherein the backrest frame comprises:

a backrest plate coupled to the seatback connector;

a lumbar placed on a front surface of a bottom of the backrest plate to support a waist of the user; and a lumbar cover coupled to a rear surface of the bottom of the backrest plate to support a load on the user's waist applied to the lumbar, and wherein a hinge joint that is coupled by means of the hinge protrudes from a bottom of the lateral center of the lumbar cover.

11. The chair according to claim 10, wherein the hinge joint is formed as an elastic body and protrudes downwards from the bottom of the backrest plate.

12. The chair according to claim 10, wherein:

the backrest plate is formed as an elastic body; and the backrest plate is formed with a plurality of slits, which penetrate forwards and backwards and elongate from side to side.

13. The chair according to claim 10, wherein:

the backrest further comprises a backrest cushion having cushioning properties and placed on a front surface of the backrest plate; and the lumbar is positioned between the backrest cushion and the backrest plate.

14. The chair according to claim 10, wherein the backrest plate has a plurality of rigid reinforcement ribs protruding from a front surface of its top above the lumbar.

* * * * *